US005898960A

United States Patent [19]

Hill

[11] Patent Number: 5,898,960

[45] Date of Patent: May 4, 1999

[54] PORTABLE LEDGE APPARATUS AND METHOD

[75] Inventor: Michael S. Hill, Flagstaff, Ariz.

[73] Assignee: Michael G. Clifton, Flagstaff, Ariz.

[21] Appl. No.: 08/908,903

[22] Filed: Aug. 8, 1997

[51] Int. Cl.[6] ..... A45F 3/24

[52] U.S. Cl. ..... 5/120; 5/122; 5/127

[58] Field of Search ..... 5/81.1, 85.1, 88.1, 5/89.1, 120, 121, 122, 123, 127, 128, 130; 297/273, 279, 280

[56] References Cited

U.S. PATENT DOCUMENTS

| | | | |
|---|---|---|---|
| 273,756 | 3/1883 | Moore | 5/120 |
| 606,282 | 12/1898 | Allen | 5/89.1 |
| 841,702 | 1/1907 | Martin | 5/89.1 |
| 842,698 | 1/1907 | Pillman | 5/89.1 |
| 1,889,925 | 12/1932 | Leninger | 5/89.1 |
| 3,234,568 | 2/1966 | Fischer | 5/89.1 |
| 5,499,408 | 3/1996 | Nix | 5/89.1 |
| 5,511,256 | 4/1996 | Capaldi | 5/89.1 |
| 5,673,444 | 10/1997 | Middendorf | 5/120 |
| 5,729,844 | 3/1998 | Kerstetter | 5/120 |

*Primary Examiner*—Brian K. Green
*Assistant Examiner*—Fredrick Conley
*Attorney, Agent, or Firm*—Harry M. Weiss; Jeffrey D. Moy; Harry M. Weiss & Associates, P.C.

[57] ABSTRACT

A portable ledge apparatus and method which may be quickly set up by a single user wherein four support arms fold into position from a central retaining member.

25 Claims, 3 Drawing Sheets

PORTABLE LEDGE APPARATUS AND METHOD

BACKGROUND OF THE INVENTION

1. Field of Invention

This invention relates generally to outdoor sports and, more specifically, to a portable ledge apparatus and method, useful for climbing and similar outdoor activities, that is quick and easy to set up.

2. Description of the Prior Art

Those engaged in the sport of mountain or rock climbing often find it necessary to bring along a portable ledge for use during a climb. The purpose of a portable ledge is to enable a climber who is ascending a face or wall lacking in natural ledges sufficiently wide to safely support a resting or sleeping climber to erect a temporary ledge on the face or wall. The portable ledge is then used as a place to rest or sleep, or perhaps to seek refuge from a storm.

A typical prior art portable ledge features a collapsible aluminum tubing frame, onto which is sewn a cloth bed. The bed is then suspended from the face or wall by a series of straps, which are generally affixed at one end on at least the four corners of the bed and perhaps at the middle of each long side. The other ends of the straps converge at a point that is substantially over the center of the bed, to form a tent or tepee-like structure, and are then connected to a bolt or other anchor that secures the portable ledge to the wall. Prior art ledges also typically come with an optional "fly"—an overhead cover that may be lowered from the top point of the structure, over the straps, to create a ledge that offers its occupants protection from the elements.

Existing portable ledges are generally cumbersome structures, making them difficult and time consuming to erect. It is not unusual for a portable ledge to take ten or more minutes to assemble, and to require the efforts of two climbers. These qualities make many prior art ledges unsatisfactory. If for example a ledge is to be used as shelter from a storm, there may not be time to erect a prior art ledge before a storm hits. But once a climber gets wet from a storm, it is generally too late to seek shelter from the storm for purposes of continuing the climb after the storm passes. Because a wet climber cannot dry off in the confines of a portable ledge, it is typically necessary in such instances to return down the mountain. It is also inconvenient and perhaps even dangerous for a climber who may be exhausted at the end of a long day of climbing, to then have to spend as much as thirty minutes erecting a ledge. And, of course, where a ledge requires the efforts of two climbers to assemble, it is not appropriate for use by a solo climber.

There are other drawbacks to the design of the prior art ledges. Because of the need for an aluminum tubing frame around the mattress, the prior art ledges can be relatively heavy—and in a sport such as climbing it is desirable to reduce as much as possible the weight of equipment that a climber must carry. The "frame" design of the prior art ledges also makes them relatively complicated and expensive to manufacture. A prior art ledge often retires as many as eight separate aluminum tubes to form the collapsible frame—two tubes along each side connected by hinges or pivots—which collapsible frame must generally be sewn into the cloth mattress. The seams on the mattress where a tube has been sewn are vulnerable to coming apart during use, requiring repair or replacement of the portable ledge.

Therefore, a need existed to provide an improved portable ledge and method, which is capable of being quickly set up by a single climber. The improved ledge and method must be relatively lightweight when compared to prior art ledges, and must be relatively easier and less expensive to manufacture. The improved portable ledge should only require four support arms, and should not require the sewing of the support arms into the mattress.

SUMMARY OF THE INVENTION

It is an object of the present invention to provide an improved portable ledge apparatus and method.

It is a further object of this invention to provide an improved portable ledge apparatus and method that may be quickly set up by a single user.

It is still a further object of this invention to provide an improved portable ledge apparatus and method that only requires four support arms.

It is yet a further object of this invention to provide an improved portable ledge apparatus and method that is lightweight and easier and less expensive to manufacture than prior art ledges.

It is yet a further object of this invention to provide an improved portable ledge apparatus and method that is easier to maintain and longer lasting that prior art ledges.

BRIEF DESCRIPTION OF THE PREFERRED EMBODIMENTS

In accordance with one embodiment of the present invention, a portable ledge apparatus is disclosed. The portable ledge apparatus comprises, in combination: mattress means for supporting a person's body in a prone position; the mattress means having a substantially rectangle shape; at least four support arms each having a first end and a second end; the first ends of each of the support arms coupled substantially at a corner of the mattress means; a retaining member located above the mattress means; the second ends of each of the support arms foldably coupled to the retaining member; and means for attaching the retaining member to a climbing surface.

In accordance with another embodiment of the present invention, a method for providing a portable ledge apparatus is disclosed. The method comprises the steps of: providing mattress means for supporting a person's body in a prone position; the mattress means having a substantially rectangle shape; providing at least four support arms each having a first end and a second end; the first ends of each of the support arms coupled Substantially at a corner of the mattress means; providing a retaining member located above the mattress means; the second ends of each of the support arms foldably coupled to the retaining member; and providing means for attaching the retaining member to a climbing surface.

In accordance with still another embodiment of the present invention, a portable ledge apparatus is disclosed. The portable ledge apparatus comprises, in combination: mattress means for supporting a person's body in a prone position; the mattress means having a substantially rectangle shape; at least four support arms each having a first end and a second end; the first ends of each of the support arms coupled substantially at a corner of the mattress means; a retaining member located below the mattress means; the second ends of each of the support arms foldably coupled to the retaining member; and means for attaching the retaining member to a climbing surface.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
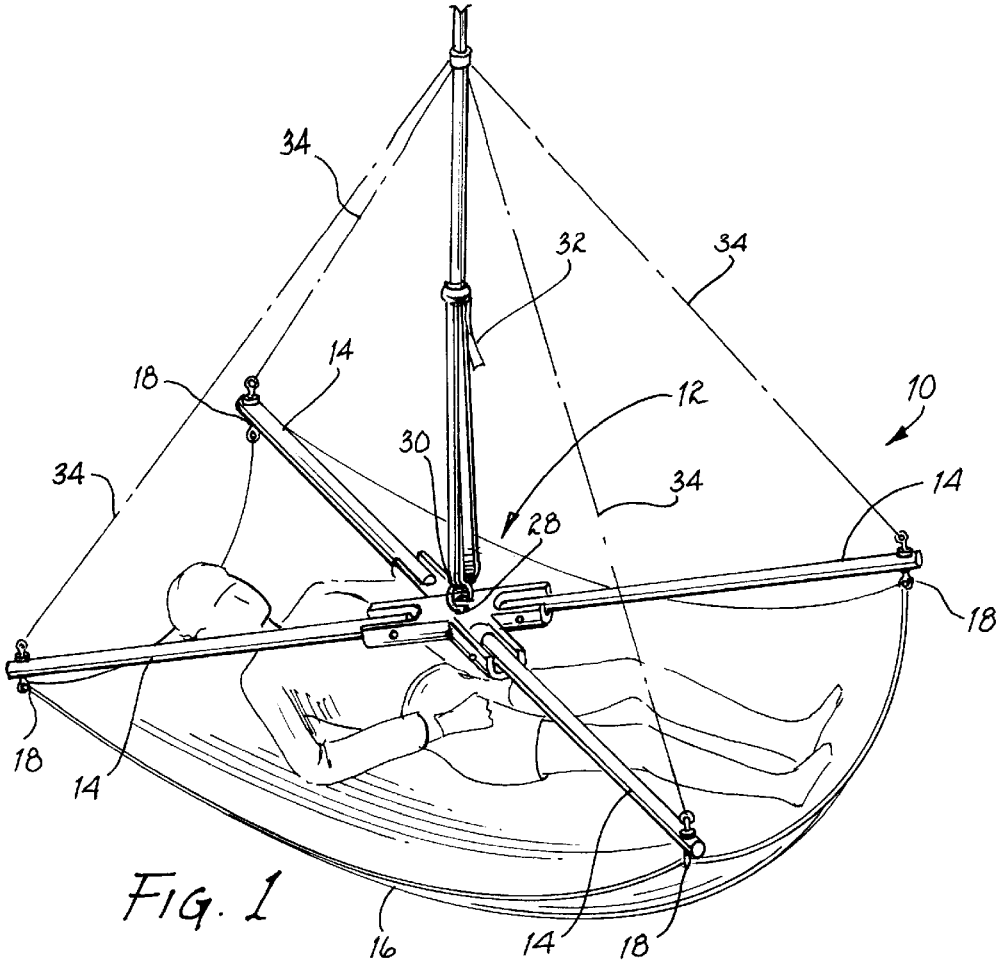
FIG. 1 is a perspective view of one embodiment of the portable ledge apparatus of the present invention, shown in use in a fully open position.
Figure 2:
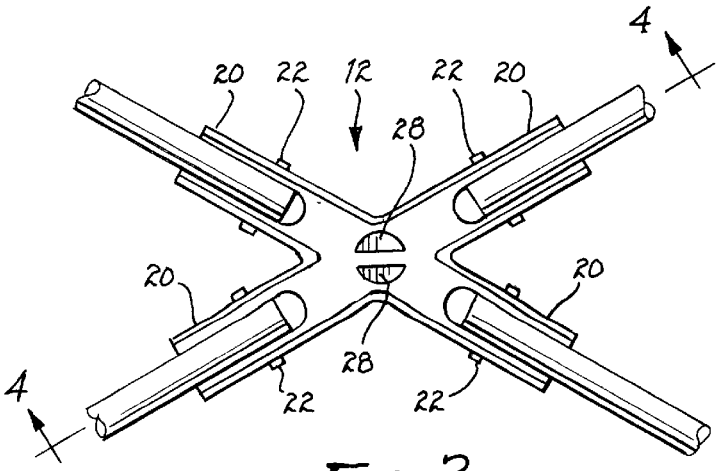
FIG. 2 is a top view of one embodiment of the central retaining member of the portable ledge apparatus of the present invention, shown with each of the support arms in a fully open position.
Figure 7:
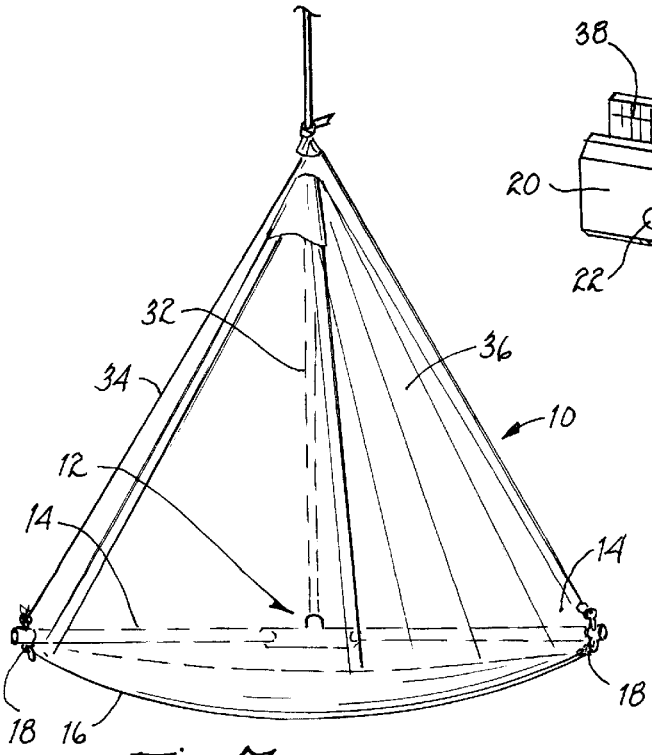
FIG. 7 is a side view of the portable ledge apparatus of the present invention, shown in a fully open position and with a cover in position over the mattress.

Referring to the embodiment of FIGS. 1 and 7, reference number 10 refers generally to one embodiment of the portable ledge apparatus of this invention. The portable ledge apparatus 10 preferably comprises a retaining member 12, support arms 14, and a mattress 16. As shown in FIGS. 1 and 7, one end of each of the support arms 14 is affixed to a corner 18 of the mattress 16. (While more than four support arms 14 could conceivably be used, extending from a retaining member with enough additional branches to accomplish the extra support arms, it is not believed that there would be substantial additional benefit to such a design.) Preferably, the support arms 14 and retaining member 12 are made from high-strength aluminum, such as 6061-T6 aircraft grade aluminum—although other high strength, lightweight materials could also be used. The mattress 16 is also of a high strength material, such as heavy duty 1000 denier coated cordura nylon with ripstop characteristics. (The analogous components of the other embodiments of the portable ledge apparatus, described below, may be constructed using the same materials.)

Figure 3:
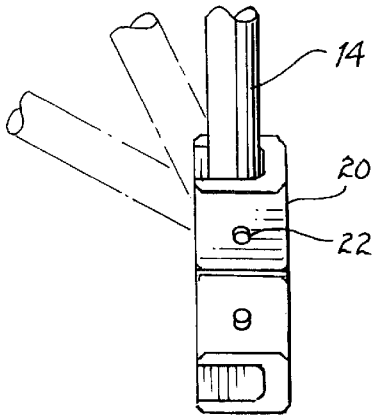
FIG. 3 is a side view of the central retaining member of the portable ledge apparatus of the present invention, showing the unfolding of a support arm to a fully open position.
Figure 4:
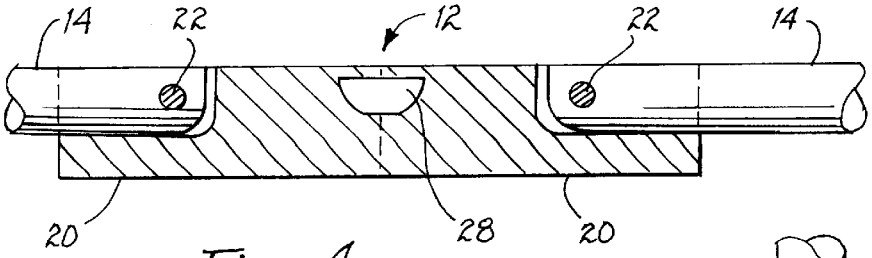
FIG. 4 is a cross-sectional view of the retaining member of the portable ledge apparatus of the present invention, taken along line 4—4 of FIG. 2.
Figure 5:
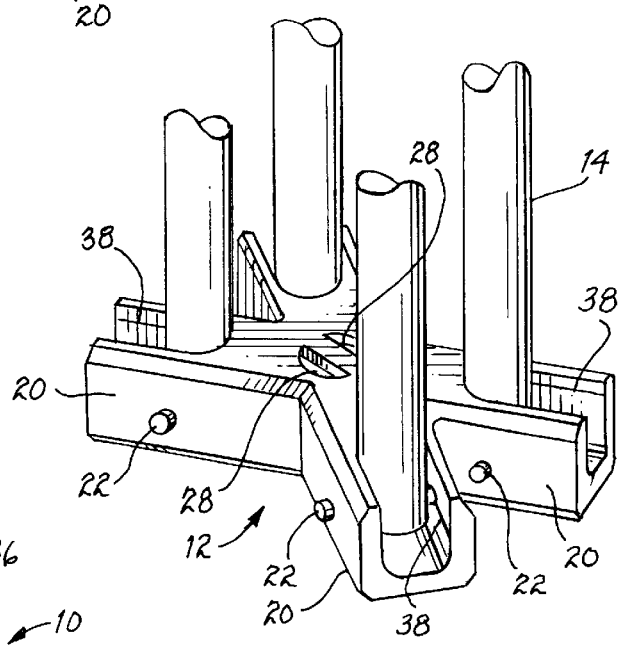
FIG. 5 is a perspective view of the retaining member of the portable ledge apparatus of the present invention, shown with each of the support arms in a fully closed position.

Referring now to FIGS. 1, 2, 4 and 5, the retaining member 12 is, in this embodiment, substantially X-shaped. Each branch 20 of the retaining member 12 foldably retains an end of a support arm 14, each of which support arms 14 pivots about a bolt 22. FIG. 3 shows the unfolding of a support arm 14 about a bolt 22.

Figure 8:
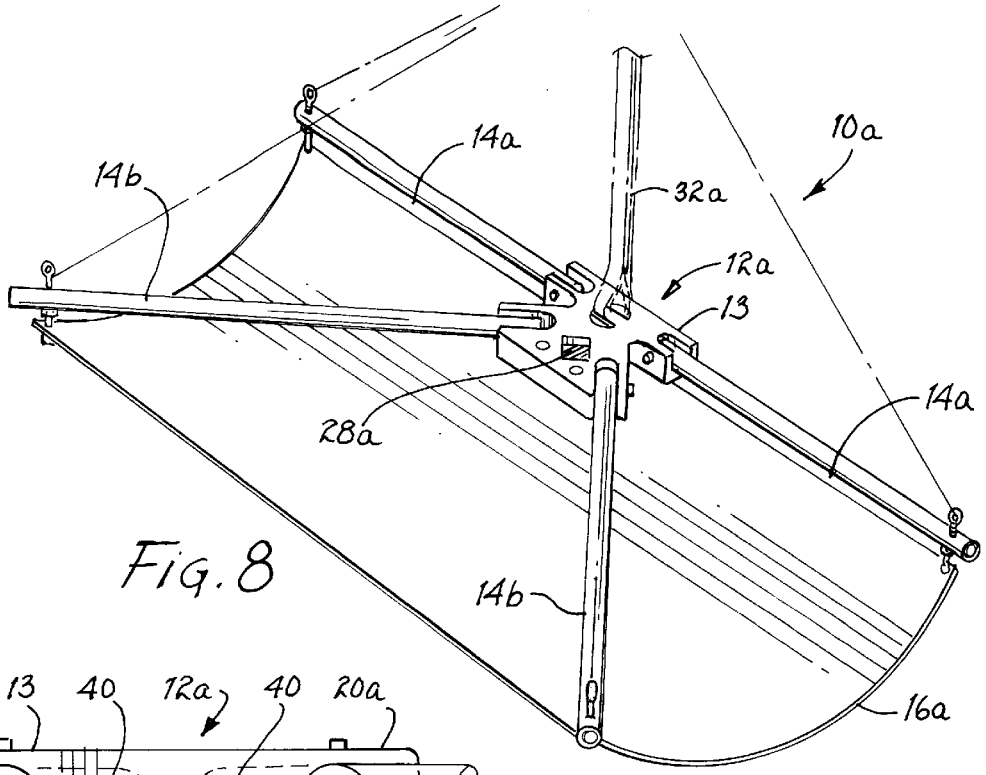
FIG. 8 is a perspective view of another embodiment of the retaining member of the portable ledge apparatus of the present invention, shown with each of the support arms in a fully open position.
Figure 9:
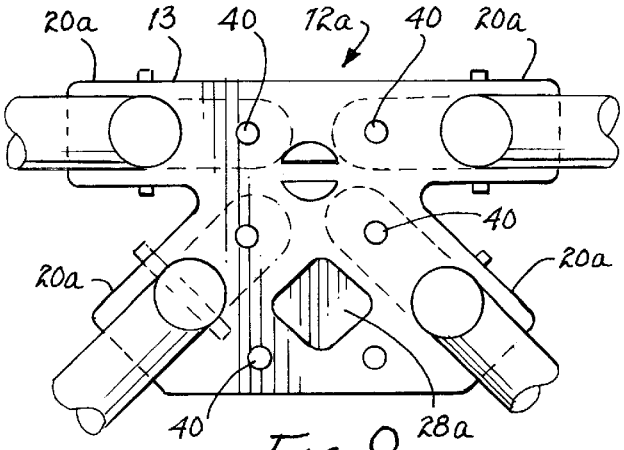
FIG. 9 is a top view of the preferred embodiment of the central retaining member of the portable ledge apparatus of the present invention, shown with each of the support arms in a fully open position.
Figure 10:
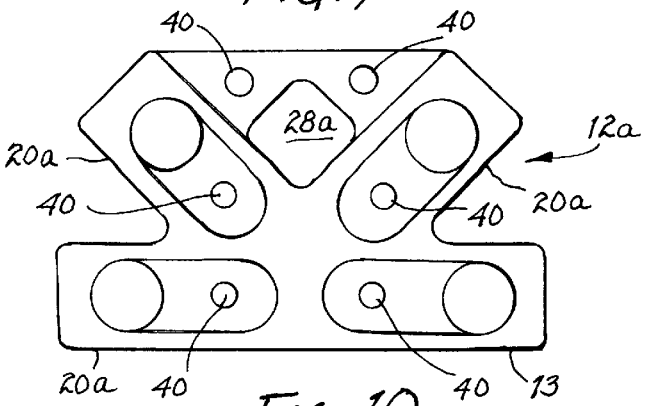
FIG. 10 is a bottom view of the preferred embodiment of the central retaining member of the portable ledge apparatus of the present invention, shown with each of the support arms in a fully open position.

Referring to FIGS. 8, the preferred embodiment of the portable ledge apparatus of the present invention, designated by reference number 10*a,* is shown. Referring to FIGS. 8–10, in this embodiment, the retaining member 12*a* is preferably K-shaped, and is located substantially above one long side of the mattress 16*a,* so that during use the long side 13 of the retaining member 12*a* contacts the wall or rock face (not shown). This preferred design features two short support arms 14*a* and two longer support arms 14*b*, which are affixed to the mattress 16*a* and which are foldably retained within the retaining member 12*a* in the same manner as discussed above with respect to FIGS. 1 and 7. One advantage of the K-shaped retaining member 12*a* is that it creates more room above the mattress 16*a* for the user (not shown).

It should be noted that the branches 20 of the retaining member 12, and the branches 20*a* of the retaining member 12*a,* need not extend at a one hundred eighty degree angle from the center of the retaining member 12 or 12*a* as shown in FIGS. 1, 4, 5, 7, and 8. The degree of the angle of the branches 20 and 20*a* may be increased as desired, for purposes of increasing the amount of space above the mattress 16 or 16*a* and/or to reduce stress on the support arms 14 or 14*a* and 14*b* or the retaining member 12 or 12*a*.

Figure 11:
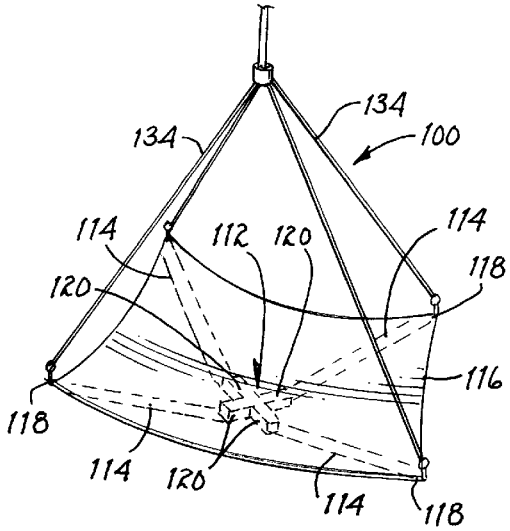
FIG. 11 is a perspective view of another embodiment of the retaining member of the portable ledge apparatus of the present invention, shown with each of the support arms in a fully open position.

Referring to FIG. 11, yet another embodiment of the portable ledge apparatus of the present invention, designated by reference number 100, is shown. In this embodiment, the retaining member 112 is preferably X-shaped, and is located below the mattress 116 and substantially underneath the center of the mattress 116. This design features four support arms 114, which extend at an angle from the retaining member 112 toward the corners 118 of the mattress 116, and are affixed thereon. The retaining member 112 is substantially the same as the retaining member 12 shown in detail in FIGS. 2–5, except that the branches 120 extend at an angle of greater than 180 degrees from the center of the retaining member 112—which retaining member 112 is deployed in an essentially upside down position as compared to the retaining member 12 as shown in FIGS. 1 and 7. In this manner, the retaining member 112 allows a user to lie in the mattress 116 and to cause the mattress 116, without the body of the user contacting the retaining member 112 through the mattress 116. Because the retaining member 112 lies below the mattress, support of the apparatus 100 is accomplished solely with the straps 134 which are affixed at the ends of the arms 114 proximate the corners 118 of the mattress 116. One advantage of this embodiment is that, by transferring the retaining member 112 below the mattress 116, it creates still further room above the mattress 116 for the user.

Figure 6:
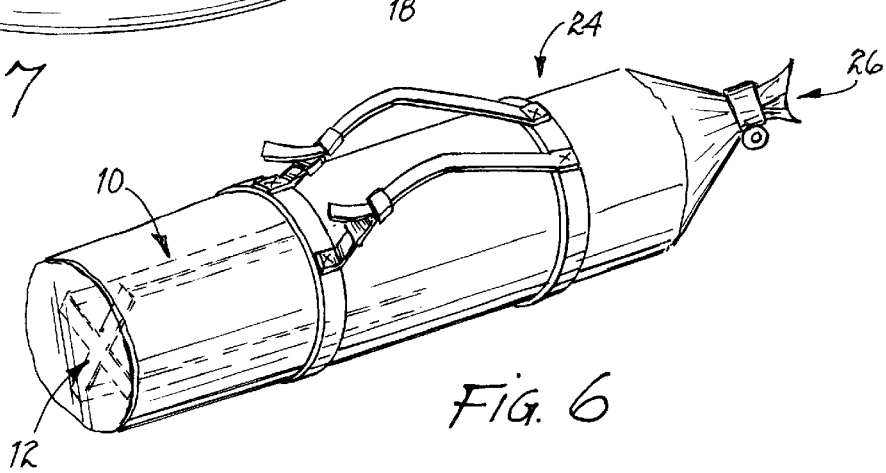
FIG. 6 is a partially cut-away, perspective view of the portable ledge apparatus of the present invention, as shown stored in a fully closed position in a backpack-type case.

Referring now to FIG. 6, the portable ledge apparatus 10 is transported in the fully closed position in a pack 24, with the retaining member 12 located at the bottom of the pace 24. (The portable ledge apparatuses 10*a* or 100 could be transported in similar fashion.) When a user desires to set up the portable ledge apparatus 10, the pack 24 is opened, and the portable ledge apparatus 10 is removed through an upper opening 26 in the pack 24. As the portable ledge apparatus 10 is removed from the pack 24 through the upper opening 26, each of the support arms 14 will begin to unfold in the manner shown in FIG. 3, a process that the user should continue until the support arms 14 are in the fully open position as shown in FIGS. 1, 2, 4 and 7. To return a portable ledge apparatus 10 to the pack 24, the process is simply reversed—the support arms 14 are folded into the closed position, and the retaining member 12 is first inserted into the upper opening 26 of the pace 24 and slid into the pace 24, until the retaining member 12 rests at the bottom of the pace 24 as shown in FIG. 6. It is estimated that the portable ledge apparatus 10 of the present invention can be set up in as little as ten seconds or less by a single user once an anchoring device (not shown) is placed in the wall or face (not shown).

Referring to FIGS. 1, 2, 4, 5, and 7, it is not necessary that the retaining member 12 incorporate structure for locking the support arms 14 into position during use. The weight of the user will be sufficient to accomplish this. However, such a locking mechanism may further ease the process of setting up the portable ledge apparatus 10, and may be incorporated into the retaining member 12 or 12*a*, Referring briefly to FIG. 5, ridges 38 may be placed on the interior of each of the branches 20, to provide resistance as the support arms 14 are unfolded, and then locking the support arms 14 into the open position as they clear the ridges 38. Ridges 38 could be placed on the retaining members 12*a* or 112 to accomplish the same effect. Of course, the locking of the support arms 14, 14*a* or 114 could be accomplished in any of a myriad of different ways, without departing from the spirit or scope of this invention.

Of course, the portable ledge apparatuses 10, 10*a* or 110 must be properly secured to a face or wall (not shown) Referring to FIGS. 1, 2, 4, and 5, the retaining member 12 has a pair of anchor slots 28, into which a carabiner or ring 30 (see FIG. 1) is inserted. Referring to FIGS. 1 and 7, an adjustable strap 32 is coupled at one and to the carabiner or ring 30 and at a second end is directly or indirectly clipped into a wall or face or suspension point (not shown). The mattress 16 of the portable ledge apparatus 10 is further supported by straps 34, which straps 34 are affixed at one end to support arms 14 proximate corners 18 of the mattress 16, and at a second end to the adjustable strap 32. Referring to FIGS. 8–10, the substantially diamond-shaped opening 38*a* receives a carabiner or ring (not shown), into which may be inserted an adjustable strap 32*a*. Still referring to FIGS. 8–10, the retaining member 12*a* preferably also has a plurality of openings 40, which are added to lighten the retaining member 12*a* and to provide locations to which a user could clap other climbing accessories with a clip (not shown).

Referring now to FIG. 11, yet another embodiment of the present invention is disclosed. In this embodiment, the retaining member 12*c* is substantially X-shaped, and has branches 20*c* which extend at angle that is greater than 180 degrees. The retaining member 12*c* lies below the mattress 16*c* and is inverted, so that the weight of the user (not shown) will force the support arms 14*c* against the retaining member 12*c*.

Referring now to FIG. 7 protection from the elements can be provided by a "fly" or overhead cover 36, which cover 36 is suspended from the adjustable strap 32 at a point that his high enough to allow the cover 36 to extend over the straps 34. Such a cover 36 could be employed with any of the three embodiments of the portable ledge apparatus disclosed herein.

The portable ledge apparatus 10 of the present invention has application beyond the sport of climbing. The apparatus 10 can be used wherever and whenever it is desired to speedily and easily erect a temporary mattress for rest. The apparatus 10 of the present invention could be used, for example, as a hammock. For such use, the second and of the adjustable strap 32 would be coupled, directly or indirectly to an appropriately strong structure—including for example a tree branch, ceiling, rafter, etc. The term "portable ledge" as used herein is intended to also include within its scope hammocks and other similar beds.

While the invention has been particularly shown and described with reference to preferred embodiments thereof, it will be understood by those skilled in the art that the foregoing and other changes in form and details may be made therein without departing from the spirit and scope of the invention.

I claim:

1. A portable ledge apparatus comprising, in combination:

support means for supporting substantially all of a person's body in a substantially horizontal position;

said support means having a substantially rectangular shape;

at least four rigid support arms each having a first end and a second end;

said first ends of each of said support arms coupled substantially at a corner of said support means;

a retaining member located above said support means having at least four branches;

said second ends of each of said support arms foldably coupled and received within said branches; and means for attaching said retaining member to a climbing surface.

2. A portable ledge apparatus in accordance with claim 1 wherein said retaining member is substantially X-shaped.

3. A portable ledge apparatus in accordance with claim 1 wherein said retaining member is located substantially above a center of said support means.

4. A portable ledge apparatus in accordance with claim 2 wherein said retaining member is located substantially above a center of said support means.

5. A portable ledge apparatus in accordance with claim 1 wherein each of said support arms i s substantially equal in length.

6. A portable ledge apparatus in accordance with claim 1 wherein said retaining member is substantially K-shaped.

7. A portable ledge apparatus in accordance with claim 6 wherein said retaining member is located nearer to a first long side of said substantially rectangle-shaped support means.

8. A portable ledge apparatus in accordance with claim 7 wherein each of a first group of two of said at least four support arms has a length that is greater than a length of each of a second group of two of said at least four support arms.

9. A portable ledge apparatus in accordance with claim 1 wherein said retaining member further comprises means for locking said second ends of each of said support arms in place when said support means is in an open position.

10. A portable ledge apparatus in accordance with claim 2 wherein said retaining member further comprises means for locking said second ends of each of said support arms in place when said support means is in an open position.

11. A portable ledge apparatus in accordance with claim 6 wherein said retaining member further comprises means for locking said second ends of each of said support arms in place when said support means is in an open position.

12. A portable ledge apparatus in accordance with claim 1 wherein said climbing surface is at least one of a tree branch, ceiling and rafter.

13. A method for providing a portable ledge apparatus comprising the steps of:

providing support means for supporting substantially all of a person's body in a substantially prone position;

said support means having a substantially rectangular shape;

providing at least four rigid support arms each having a first end and a second end;

said first ends of each of said support arms coupled substantially at a corner of said support means;

providing a retaining member located above said support means having at least four branches;

said second ends of each of said support arms foldably coupled and received within said branches; and providing means for attaching said retaining member to a climbing surface.

14. The method of claim 13 wherein said retaining member is substantially X-shaped.

15. The method of claim 13 wherein said retaining member is located substantially above a center of said support means.

16. The method of claim 14 wherein said retaining member is located substantially above a center of said support means.

17. The method of claim 14 wherein each of said support arms is substantially equal in length.

18. The method of claim 13 wherein said retaining member is substantially K-shaped.

19. The method of claim 18 wherein said retaining member is located nearer to a first long side of said substantially rectangle-shaped support means.

20. The method of claim 19 wherein each of a first group of two of said at least four support arms has a length that is greater than a length of each of a second group of two of said at least four support arms.

21. The method of claim 13 wherein said step of providing said retaining member further comprises the step of providing means for locking said second ends of each of said support arms in place when said support means is in an open position.

22. The method of claim 14 wherein said step of providing said retaining member further comprises the step of providing means for locking said second ends of each of said support arms in place when said support means is in an open position.

23. The method of claim 18 wherein said step of providing said retaining member further comprises the step of providing means for locking said second ends of each of said support arms in place when said support means is in an open position.

24. A portable ledge apparatus comprising, in combination:

support means for supporting a person's body in a prone position;

said support means having a substantially rectangle shape;

at least four support arms each having a first end and a second end;

said first ends of each of said support arms coupled substantially at a corner of said support means;

a retaining member located below said support means having four branches;

said second ends of each of said support arms foldably coupled and received within said branches;

and means for attaching said retaining member to a climbing surface.

25. A portable ledge apparatus in accordance with claim 24 wherein said retaining member is substantially X-shaped.

* * * * *